United States Patent [19]

Mio et al.

[11] Patent Number: 4,699,543

[45] Date of Patent: Oct. 13, 1987

[54] SLOPE PAVING MACHINE

[75] Inventors: Kohei Mio; Yukio Yamagishi, both of Tokyo; Hiroshi Ishikawa, Chofu; Mitsuo Fukukawa, Kuki; Shigeyuki Takahashi, Tokorozawa, all of Japan

[73] Assignees: Kajima Corporation; Kajima Road Company, both of Tokyo, Japan

[21] Appl. No.: 827,688

[22] Filed: Feb. 10, 1986

[51] Int. Cl.[4] ..... E01C 19/22

[52] U.S. Cl. ..... 404/109; 404/96; 404/104; 404/127; 405/268

[58] Field of Search ..... 404/96, 101, 104, 108–110, 404/127; 405/268

[56] References Cited

U.S. PATENT DOCUMENTS

| | | | |
|---|---|---|---|
| 3,130,654 | 4/1964 | Apel et al. | 404/104 |
| 4,167,360 | 9/1979 | Dick, Jr. | 404/96 X |

FOREIGN PATENT DOCUMENTS

| | | | |
|---|---|---|---|
| 1403237 | 5/1965 | France | 404/127 |
| 47-42309 | 10/1972 | Japan . | |
| 48-7296 | 3/1973 | Japan . | |
| 57-34402 | 7/1982 | Japan . | |
| 472185 | 10/1975 | U.S.S.R. | 404/96 |
| 715695 | 2/1980 | U.S.S.R. | 405/268 |
| 746018 | 7/1980 | U.S.S.R. | 404/127 |
| 874839 | 10/1981 | U.S.S.R. | 404/104 |

*Primary Examiner*—Stephen J. Novosad
*Assistant Examiner*—John F. Letchford
*Attorney, Agent, or Firm*—Armstrong, Nikaido, Marmelstein & Kubovcik

[57] ABSTRACT

A slope paving machine is composed of a wheeled truck, a boom device mounted on and extending from said truck, a pavement finisher which is suspendable from the forward end of said boom device and hingedly connected thereto, and a conveyor mounted on and extending from said truck. The pavement finisher is capable of traveling on a sloped surface in a direction at right angles to a line of slope.

4 Claims, 10 Drawing Figures

SLOPE PAVING MACHINE

FIELD OF THE INVENTION

This invention relates to a slope paving machine, having pavement finisher traveling on a sloped surface in a direction at right angles to a line of slope.

BACKGROUND OF THE INVENTION

Some of sloped surfaces of gravity dams, coastal breakwaters, flood banks of rivers, dykes and the like need to be lined with asphalt pavement. Conventionally, such sloped surfaces have been paved by a using a device commonly referred to as a sloped finisher. Various slope finishers have been proposed for this purpose, and are described in Japanese Patent Publications, Nos. 47-42309, 48-7296 and 57-34402 may be cited among others.

These conventional finishers, particularly that described in No. 47-42309, are not complete with a device for laying and spreading asphalt mixture on a sloped surface. Thus, their operation is based on the use of a separate asphalt-mixture laying and spreading device.

SUMMARY OF THE INVENTION

An object of this invention is to provide a slope paving machine capable of easily paving the sloped surface with high working efficiency.

Another object of this invention is to provide a slope paving machine being capable of effective working even when a radius of curvature of a sloped surface is small, and of absorbing difference in travelling speed between a finisher and a wheeled truck carrying the finisher thereby.

According to this invention, there is to provide a slope paving machine which comprise a wheeled truck on a rail track laid out on the horizontal ground surface and extending along and close to the foot of the sloped surface; a boom device mounted on and extending from said truck capable of varying length and elevatin angle thereof; a pavement finisher suspended from the forward end of said boom device and hingedly connected thereto with rocking movement; and a conveyor mounted on said truck capable of extending from the truck to a discharging end located at or near said pavement finisher.

BRIEF DESCRIPTION OF THE DRAWINGS

The above and other objects and the attendant advantages of the present invention will become readily apparent by reference to the following detailed description when considered in conjunction with the accompanying drawings wherein.

DETAILED DESCRIPTION OF PREPERRED EMBODIMENTS

Figure 1:
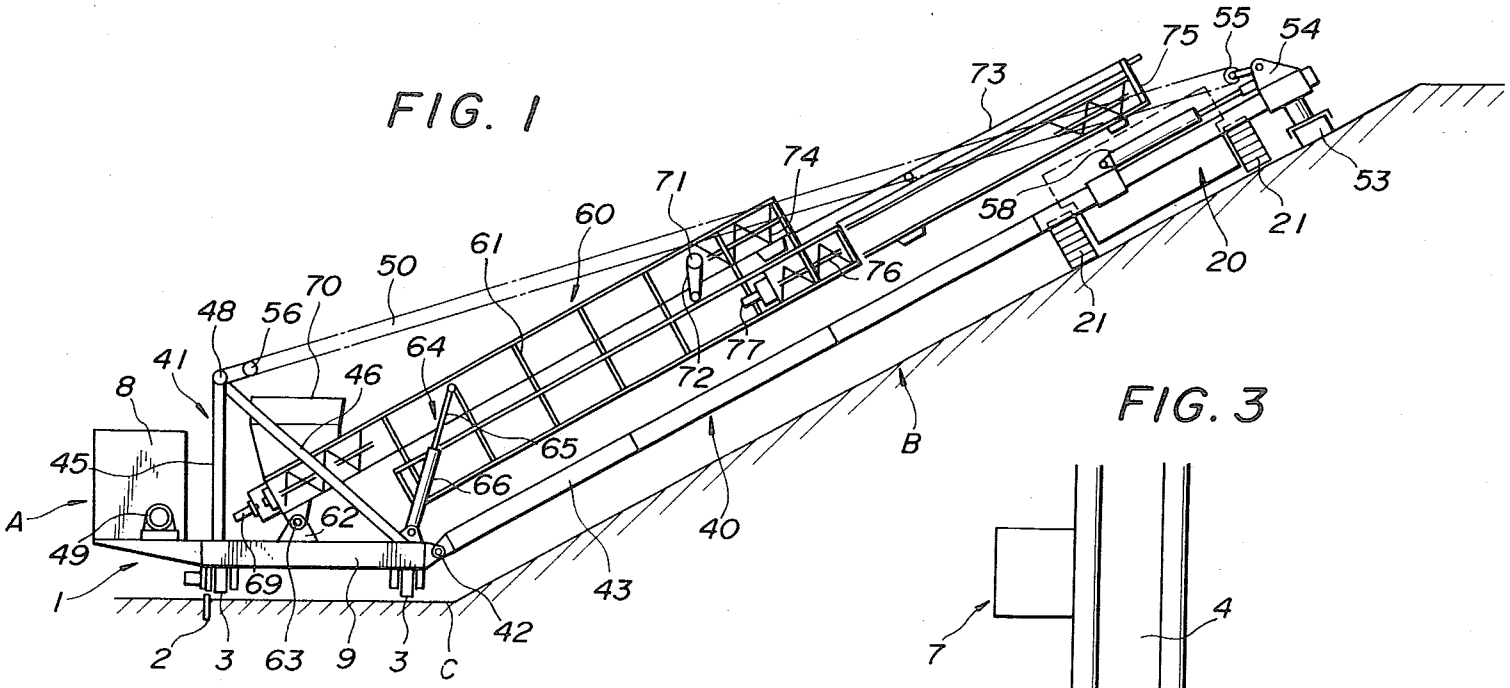
FIG. 1 is a side view of an embodiment of this invention

The slope paving machine according to this invention being complete with the device for supplying the asphalt mixture to the surface to be paved, improved working efficiency is assured of its operation.

Sloped surfaces may be curved more or less sharply, as seen in the plan, possibly resulting in some difference in traveling movement between the truck on the track and the pavement finisher at the forward end of the elevated boom but, since the truck and the pavement finisher are disparate traveling devices, such a difference can be readily accommodated to prevent the difference from interfering with uniform paving operation.

Also, the slope paving machine according to this invention can effectively work even when the radius of curvature of the sloped surface is small, and is capable of absorbing the difference, if any, in traveling speed between its finisher and wheeled truck. Since the finisher is supported through wire cables, it readily responds and conforms to warped or curved parts, if any, of the sloped surface, and since its variable-length conveyor extending from the truck to the finisher is supported by the boom device according to this invention, the feature of the boom device serving the double purpose of supporting both finisher and conveyor simplifies the machine construction, making it available at a lower cost. Needless to say, the asphalt mixture is conveyed from the hopper on the wheeled truck to the finisher in the slope paving machine of this invention. In its embodiment, however, addition of a pair of auxiliary wheels to the tuck in such a way that the additional wheels catch hold of the rail track is preferred: these auxiliary wheels are to guide the truck wheels supporting the truck and all its loads and rolling on the rails, to take up horizontal forces acting on the truck during operation, and to prevent the truck from getting derailed even when the radius of slope curvature is unusually small.

A conveyor, whose conveying length can be increased or decreased as desired, extends from the truck to the pavement finisher at the forward end of the boom to transport the asphalt mixture initially fed into the truck-mounted hopper, way up to the finisher, thereby ensuring the supply of the mixture to the surface wherever the finisher may be at on the line of slope.

Referring now to the drawing, the first embodiment of the present invention will be described.

Figure 3:
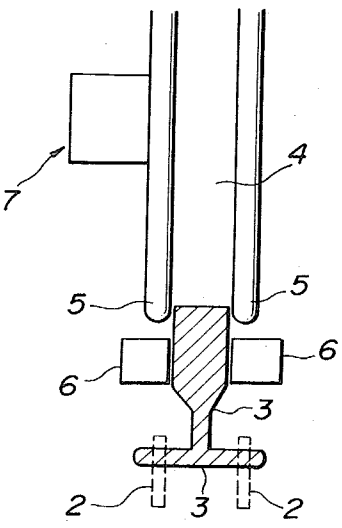
FIG. 3 is a side view of a supporting wheel and auxiliary wheels shown in FIGS. 1 and 2.
Figure 2:
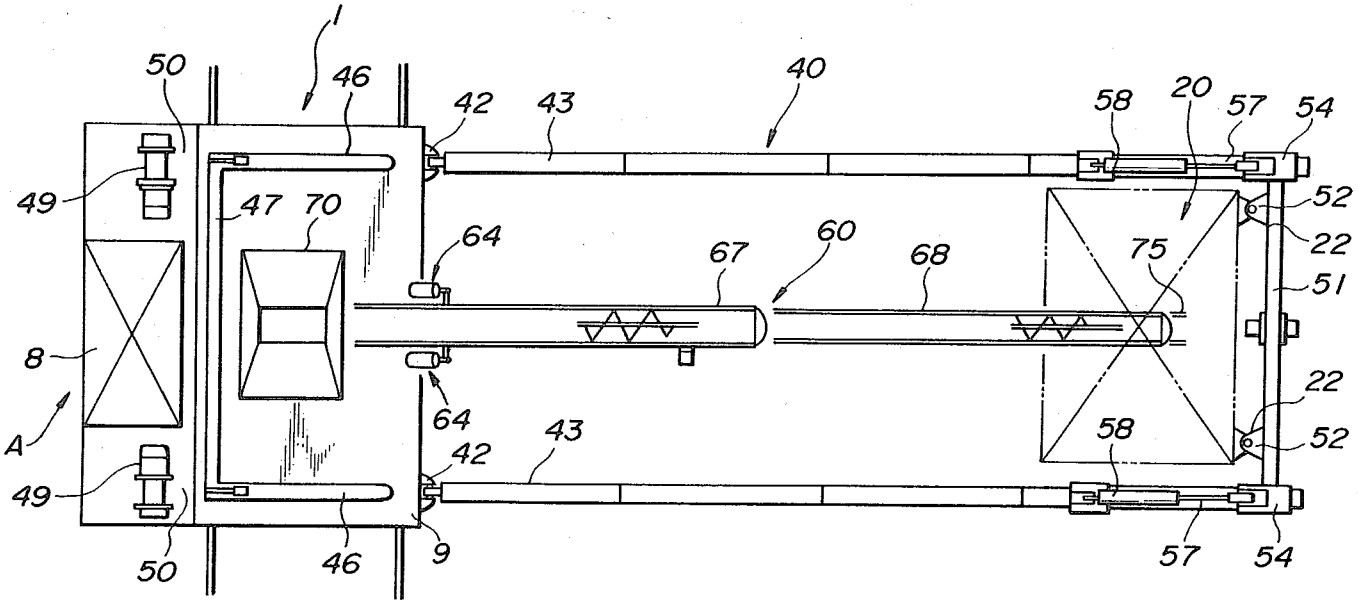
FIG. 2 is a plan view of FIG. 1.

In FIGS. 1, 2 and 3, a slope paving machine A has, among other things, a wheeled truck 1, whose supporting wheels 4 ride on rail track, a pavement finisher 20, which is to travel on sloped surface B to be paved, and an extendable conveyor 60 of such as screw type, whose intake end is at the truck 1 and discharge end at the finisher 20.

The truck 1 travels on a horizontal surface C contiguous to the sloped surface B by its supporting wheels 4 riding on a pair of rails 3, which are laid down along and approximately parallel to the sloped surface and secured in place with stakes 2 driven into ground. The supporting wheels may be of known single-flanged type like the one used in railway cars or may be of double-flanged type having two flanges 5, one on each side of wheel. Preferable, a pair of auxiliary wheels 6, one on each side of the rail, should be affixed to the truck in order to take up horizontal forces acting on the truck in operation. Since truck 1 is obviously self-powered and capable of traveling on the rail track by its own power, at least one of its four supporting wheels is a drive wheel receiving drive from a motor 7, FIG. 3.

A hydraulic power unit 8, mounted on the truck 1, generates hydraulic power to be distributed to the motors 7 and to the other hydraulically powered devices to be presently described. The pavement finisher 20 is of known crawler type, traveling by its two crawlers 21; it has an asphalt-mixture inlet at its top part and an outlet at its bottom part, feeding out the mixture from its outlet onto sloped surface B, and compacts the spread mixture by rolling into a pavement in the known manner. The finisher 20 on sloped surface depends from a cross bar 51, a foremost structural member of a boom device 40, through brackets 52 and a link pins 22.

The boom device 40 is constructed with a rigid framework 41 mounted on a truck chassis 9 and a pair of booms 43 connected pivotally through pivot pins 42 to the truck chassis 9 at the front and rear end parts on its sloped side. A framework 41, a rigid builtup structure, consists essentially of two supporting uprights 45 spaced apart in correspondence to the two boom pivots, two diagonal braces 46 between tops of the uprights 45 and the chassis 9, and a transverse bar connecting the two top ends of the uprights 45. A guide pulley 48 is mounted at each upright 45 for guiding a wire cable 50 from a hydraulic winch 49 set on the chassis 9 toward foremost boom end. Thus, there are provided two winches 49, each serving its own boom 43.

The pair of booms 43 are identically in sections jointed together in such a way as to permit the number of sections to be increased by adding sections or decreased by removing sections to vary the boom length as desired, each foremost section being complete with a bracket 54 capable of sliding on the section and a boom wheel 53 arranged to roll on the sloped surface while supporting the foremost boom end, there being provided on the each bracket 54 and a cable block 55 for passing the wire cable. A cross bar 51, mentioned above, has its ends connected to these brackets 54 to hold the foremost ends of the booms 43 together. The two wire cables 50 are reeved through blocks 55 and similar blocks 56 mounted next to said guide pulleys 48 on the uprights 45, one cable to one boom, such that, when the two hydraulic winches 49 are operated in unison to draw in or pay out the cable wires, the booms 43 will identically rise or fall: the boom device 40 is to be positioned at the desired angle of elevation in this manner. The slidable brackets 54, rigidly held together by the cross bar 51, are each connected to a telescopically movable piston rod 57 of a hydraulic cylinder 58, whose cylinder part is pivotally anchored to the boom 43, so that, by identically controlling the hydraulic pressure applying to the two cylinders 58, the two brackets 54 and the cross bar 51 as a unit can be pushed uphill or pulled downhill: a working position of pavement finisher 20 is to be adjusted along the line of slope by so displacing the cross bar 51, to which the finisher 20 is connected.

A conveyor device 60 for transporting the asphalt mixture from the truck 1 to the pavement finisher 20 is of screw-in-tube type in the illustrated embodiment, and consists of two conveyor lines, named No. 1 conveyor, which is fixed in place, and No. 2 conveyor, which is slidably mounted, both being supported by a truss framework 61 whose inner end is pivotally connected to a bracket 62 on the truck chassis 9 through a pivot pin 63. The conveyor framework 61 has its intermediate part buttressed by two piston rods 65, one on each side, of a hydraulic cylinders 66 anchored to the truck chassis 9, so that, by operating these hydraulic cylinders, framework 61, carrying No. 1 conveyor 67 and No. 2 conveyor 68, can be angled as desired.

The screw of No. 1 conveyor 67 is driven by hydraulic motor 69 mounted on its lowermost end, above which is provided hopper 70 for receiving the asphalt mixture at a location calculated to counterbalance the load imposed on chassis 9 by boom device 40. The mixture is drawn from hopper 70 by the screw of No. 1 conveyor 67 and pushed up in the known manner to its upper end, from which the mixture is fed by gravity onto the lowermost end of No. 2 conveyor 68, which is arranged to slide, as actuated by hydraulic motor 71 through chains 72 and 73, in the direction of the line of slope. Needless to say, the mixture outlet of No. 1 conveyor is always directly above the mixture inlet of No. 2 conveyor: if this outlet of No. 1 conveyor were fixed and not relocatable, it would locate itself off No. 2 conveyor's inlet point when the latter conveyor is displaced. This is to be avoided in the present slope paving machine in a manner which is obvious to anyone skilled in this art but will be briefly outlined: make a longitudinal slit in the outlet portion of screw-containing tube of No. 1 conveyor; cover the slit with a slidable lid; and arrange the lid to be slid back and forth to displace the outlet or pouring point to suit the location of the mixture inlet of No. 2 conveyor. A mixture-discharge chute 75 of No. 2 conveyor opens out to the hopper on the pavement finisher 20 and can be relocated by sliding No. 2 conveyor in place according as the finisher 20 is displaced along the line of slope. A hydraulic motor 77 for driving No. 2 conveyor screw in mounted at the end of this conveyor tube; its drive capacity as well as the conveying capacity of No. 2 conveyor is sized slightly larger than that of No. 1 conveyor for the obvious reason.

Having thus made clear the construction of the preferred embodiment, how it is placed in operation and put to work will be explained.

First, lay the track of rails 3 on level ground C along the foot of sloped surface B to be paved; set the truck 1, complete with the boom device, the conveyor device and the pavement finisher, on the rail track; start up the power unit 8; operate the winches 49 and the hydraulic cylinders 66 to hold the boom device and the conveyor device in a proper angular position; drive the wheeled truck 1 on the track to the position where the paving work is to be commenced; lower the boom device to land the pavement finisher on the slope; adjust the length of the boom device by adding one or more extra sections to or removing one or more existing sections from the booms 43, as necessary, in order to locate the pavement finisher at the desired position on the line of slope; adjust the position of pavement finisher by operating the hydraulic cylinders 58 to displace the cross bar 51 uphill or downhill; and set the conveyor device in conveying position with its discharge chute meeting the hopper on the finisher.

The machine having been set up as above, fill up the hopper 70 on the truck 1 with the asphalt mixture, run No. 1 conveyor 67 and No. 2 conveyor 68 to feed the mixture into the hopper of the finisher, and start running the pavement finisher as it starts spreading the mixture on the sloped surface, thereby compacting the mixture spread by rolling into a pavement.

Figure 4:
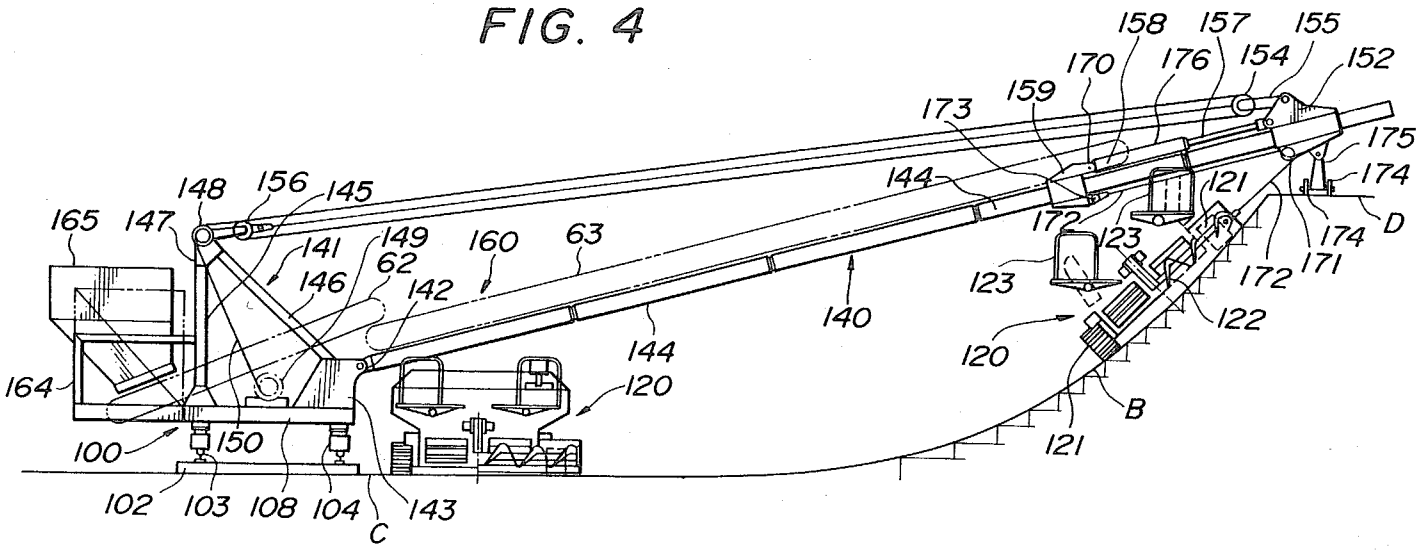
FIG. 4 is a side view of another embodiment of this invention.
Figure 5:
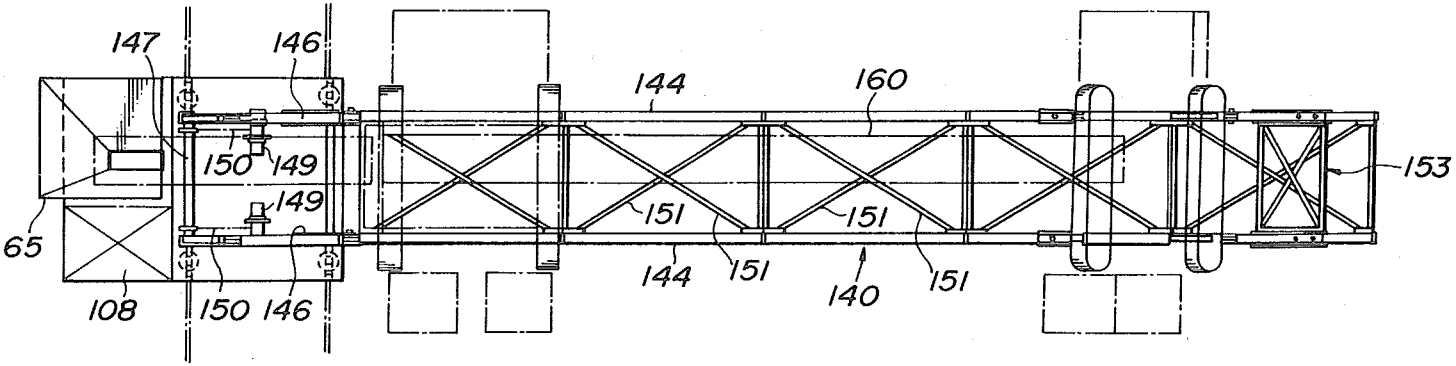
FIG. 5 is a plan view of FIG. 4.

FIGS. 4 and 5 show the second embodiment of this invention. A slope paving machine comprises a wheeled truck 100, a finisher 120 on a sloped surface B to be paved, a boom device 140 mounted on the truck 100 and supporting the finisher 120, and a variable-length conveyor 160, which may be a belt conveyor as shown, extending from above the truck 100 and terminating at the finisher 120.

The truck 100 has a plurality of wheels 104, which ride on the rails 103 secured to cross ties 102. The rail track formed with the rails 103 and the ties 102 is laid out on a horizontal surface C contiguous to the foot of a sloped surface B. The wheels 103, rolling on the rail track, may be of the single-flanged type that is commonly used in railway or cars of a double-flanged type having two flanges as shown in FIG. 3. And the truck 100 is also preferably self-powered and, when it is self-powered, at least one of its four wheels 103 is to be a drive wheel receiving drive from such as a hydraulic motor.

A hydraulic power unit 108, generating hydraulic power to be distributed to said motor and to the other hydraulic actuators and devices which will be presently dealt with, is mounted on the deck of the truck 100. The finisher 120 is a self-propelling vehicle of known construction, complete with two crawlers 121 and having an asphalt-mixture inlet provided at its top side and a mixture outlet provided at its bottom side, and, as it travels by its crawlers on the sloped surface, it continuously deposits the mixture on the surface and compacts the spread mixture by rolling into a pavement. On the sloped surface, the finisher 120 is suspendedly supported by bracket 152 through wire cables 172. The construction of the finisher 20 itself is too well known to those skilled in this art to require a detailed description; it should be pointed out that the finisher 120 is equipped with screws 122 to push the asphalt mixture distributively and also with compacting rollers to compact the spread mixture on the surface.

The boom device 140 is composed essentially of a framework 141, rigidly secured to the chassis 108 of the truck 100, and a boom 144, each being pivotally pinned to a bracket 143 integral with the truck chassis 108. The framework 141 is built with a uprights 145, spaced apart 5 in correspondence to the spacing of the booms 144 and standing at the off-side part, as seen from sloped surface side, of the truck chassis 108, a transverse bar 147 set between the uprights 145 and rigidly connected to their tops, and braces 146, one brace to each upright 145. At the top of each upright 145 is mounted a guide pulley 148 for a boom cable 150 which is reeved between the foremost part of the boom and a hydraulic winch 149 rigidly mounted on the truck chassis 108, in order to guide the cable 150 being drawn in or paid out by the winch.

Two booms 144, identically shaped to constitute a pair, the support finisher 120 as well as the belt conveyor 160; they are connected together with cross and diagonal members 151 to present a truss structure in order to retain the strength necessary for supporting said two devices. Each boom 144 is, moreover, built with unitized boom sections, each section being sized about 3 meters in length in consideration of the width of the finisher 120 and other factors, and is arranged to permit the number of sections to be increased or decreased, as necessary, to change the boom length.

On each foremost boom section is slidably mounted the bracket 152, which carries a pulley 154 and an arm 155 in such a way that the pulley is capable of rocking motion with its arm. The two brackets 152 of the two booms are rigidly connected together with a truss frame 153. The boom cables 150 run through these pulleys 154 and, at the truck 100, through corresponding pulleys 156 similarly held from the tops of the uprights 145, and are drawn in or paid out by respective winches 149 in order to raise or lower the boom device 140 in elevation. Obviously, the two winches are to be operated in step to each other to change the angle of elevation.

A telescopic hydraulic cylinder 176 is provided on each boom between said slidable bracket 152 and an anchoring bracket 159 rigidly attached to the boom section 144, with its piston rod 157 connected to the bracket 152 and its cylinder tube 158 connected to the bracket 159 with pin 170, such that, by controlling the hydraulic pressure applying to the two hydraulic cylinders 176, one on each boom, the two brackets 152 and truss frame 153 as a unit can be displaced to adjust its position. On the underside of each slidable bracket 152 is mounted a guide pulley 171 for guiding a suspension cable 172, whose one end is hitched to the finisher 120 and other end is taken up at said anchoring bracket 159 by such as a winch 173 mounted thereon. Thus, the finisher 120 on the sloped surface B is held in position by the two cables 172 and can be displayed along the line of slope by operating the winch means at the brackets 159. The foremost end of the boom device 140 is arranged to rest on and travel along the horizontal surface D at the top of the sloped surface B during paving operation through wheeled bolsters 175, one bolster to one boom, hinged to the slidable brackets 152 and each having a wheel 174.

The conveyor for transporting the asphalt mixture from the wheeled truck 100 to the finisher 120 is a belt conveyor 160 in the illustrated example of this invention, and is arranged to permit its conveying length to be varied as desired in that it consists of two line parts, namely, No. 1 conveyor 62 supported by and extending across the width of the truck 100 and No. 2 conveyor 63 supported largely by the boom device 140 and extending to above the finisher 120 in it working position, there being a partial overlap between the two: the whole conveyor length can be varied by varying the amount of this overlap. For this purpose, No. 1 conveyor 62 may be displaced lengthwise or, alternatively, No. 2 conveyor 63 may be similarly displaced, by means not illustrated in the drawing. It is readily conceivable, further, that the same purpose can be accomplished by sliding the two counter to each other. At truck 100, a hopper 165 for receiving the mixture is mounted by means of support columns 164 on that side of the truck chassis 108 where it counterbalances the load imposed on the truck 100 by the boom device 140. From the hopper 165, the mixture is fed onto No. 1 conveyor 62, which releases it onto No. 2 conveyor 63, from whose end it is released into the hopper of the finisher 120. No. 1 and No. 2 conveyors are individually driven, with No. 2 conveyor being sized slightly larger in capacity.

In, installation of the machine, the first step is to install the rails 103 on the level surface C along the foot of the sloped surface B to be paved; the truck 100 is set on the rail truck and assembled with the boom device and the conveyor device; the finisher 120, separately set on the slop by crame are connected with the truck 100 through cables 172; the hydraulic winches 149 on the truck 100 are operated to angle the boom device as desired; and the truck 100 is driven on the track to locate the machine at the starting point of paving work. Needless to say, the boom length is to have been adjusted in the manner already explained. The finisher 120 is lowered onto the sloped surface B, and its position along the line of the slope is adjusted, as necessary, by operating the telescopic hydraulic cylinders 176 or by winding in or paying out the two suspension cables 172.

The slope paving machine having been set up as above, the asphalt mixture is to be supplied into the hopper 165 on the truck 100. This is followed by the starting up of No. 1 conveyor 62 and No. 2 conveyor 63 to convey the mixture to the finisher 120. While the mixture is being continuously conveyed to the finisher 120, the truck 100 and the finisher 120 are to be driven in step to each other, so that the rate of mixture supply from the hopper 165 to the finisher 120 will be just right for the traveling speed of the finisher 120, from which the mixture is spread out onto the surface while the finisher 120 is travelled.

Figure 6:
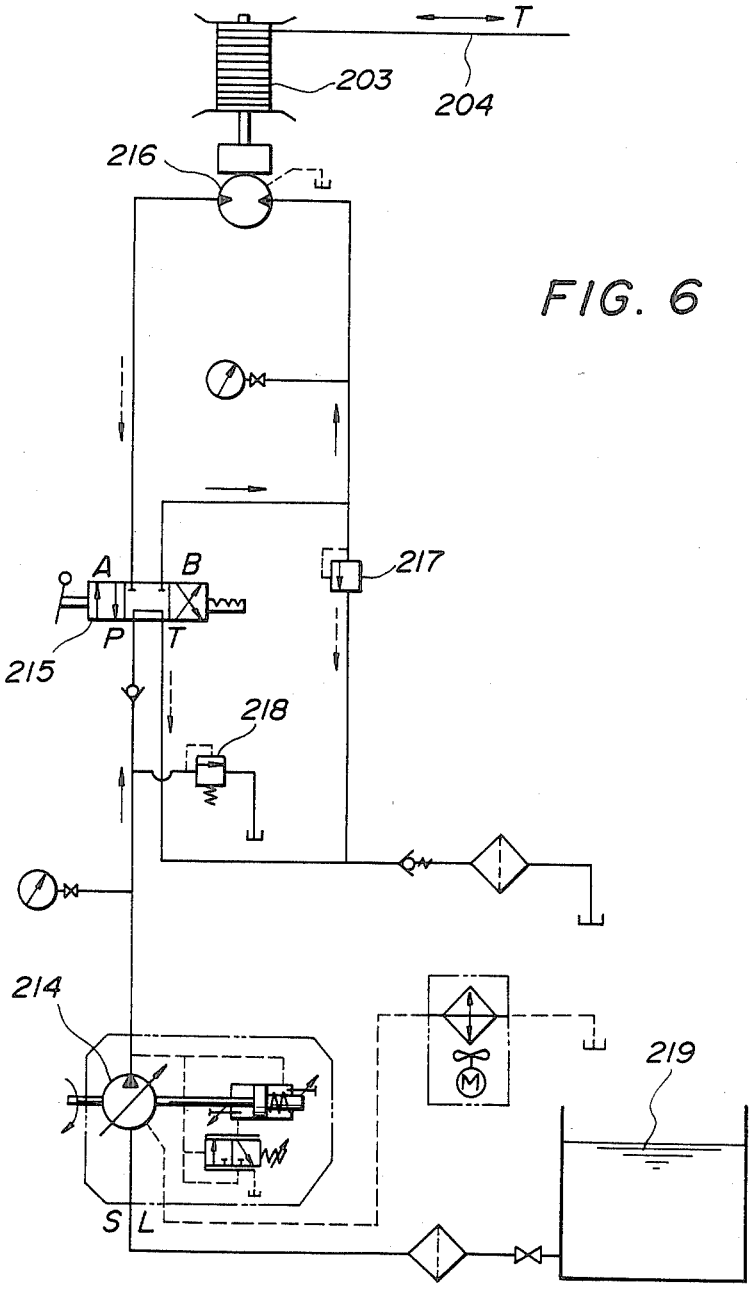
FIG. 6 is a circuit diagram of a constant-tension hydraulic used in the slope paving machine shown in FIG. 4.

Next, a holding mechanism of a compaction roller 201 for paving an asphalt mixture which is uniformly spread by the finisher 120, is illustrated as follows. An example of the constant-tension hydraulic winch preferred for use in the embodiment of this invention will be explained in reference to FIG. 6, wherein a winch is shown as composed essentially of a hydraulic pump 214, which maintains its discharge pressure constant by automatically throttling its discharge flow when discharge pressure reaches a predetermined level, direction-of-rotation selector valve 215, a hydraulic motor 216 for driving the winch drum, relief valves 217, 218, an oil tank 219 and interconnecting oil pipes.

The winch device is to be operated as follows: compute the tensile force T required of a wire rope 204, and set the relief valves 217, 218 so that the sinding force of a winch drum 203 will match the computed value. Start up the hydraulic pump 214, and pull a lever of the selector valve 215 into port B position. Under this condition, high-pressure oil discharged by the pump 214 flows in a path represented by unbroken-line arrows to drive the winch drum 203 in winding-up direction; oil returning from hydraulic motor flows back to the tank 219 through the path represented by the broken-line arrows.

Suppose the tension in the wire rope 204 reaches the required value: this will raise a discharge line pressure to the set level of the relief valve 217, which then bleeds oil into the return line leading to the oil tank 219, thereby causing the hydraulic motor 216 to stop running and hold the winch drum 203 steady. At this juncture, the hydraulic pump 214, responding to discharge pressure, automatically starts throttling its discharge flow to a level corresponding to the rate of relieved oil flow, whereby wasteful rise in oil temperature is avoided.

The selector valve 215 is to be moved into its port A position to pay out the wire rope 204 when the winch 203 becomes unloaded. The relief valves 218 is a safety valve and opens when the discharge pressure of the hydraulic pump 214 peaks due to failure or trouble of a hydraulic device.

Figure 7A:
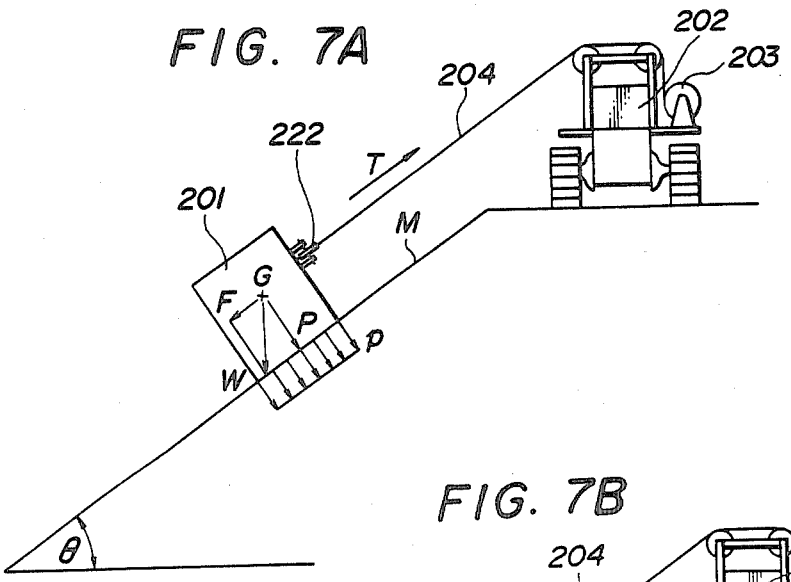
FIGS. 7A and 7B are side views showing a roller carried by a wire rope extending from a hydraulic winch.

In reference to FIG. 7A, wherein forces involved are vectorially indicated, note that compaction roller 201 is in perfectly stable condition with the wire rope 204 pulling it with its tensile force T corresponding to force component F of the roller's weight acting at its center of gravity G.

If, under this condition, a steering handle is operated to steer the roller toward uphill side on a sloped surface M in order to shift its compacting lane upward, tension T in the rope will decrease, resulting in a drop in line pressure. Consequently, the hydraulic pump 214 starts supplying high-pressure oil to run the winch drum 203 in winding-up direction to increase the rope tension. Thus, the compaction roller 201 remains pulled with a constant rope tension while it is shifting to a new compacting lane on the upper side.

Consider the reverse case: the handle is operated in order to shift the compacting lane downward. In this case, the tension of the wire rope 204 will increase, causing the hydraulic motor 216 to be rotated in reverse direction. As the motor 216 starts rotating backward, the line pressure will rise and, if it exceeds the pressure setting, the relief valve 217 will open to bleed high-pressure oil toward the tank 209, so that the winch drum 203 pays out the rope rather slowly to allow compaction roller 201 to change its course to downhill side on the surface M. It should be pointed out that the constant-tension winch is not limited to hydraulic type and may be of penumatic type just as well. As illustrated heretofore, according to the present invention the roller 201 may shift the course easily with steering operation in a similar manner as done in a plain area, if the constant-tension winch may be used. Furthermore, since the roller pressure p perpendicular to the sloped surface may be maintained uniformly, the uniform paving is obtained.

Figure 7B:
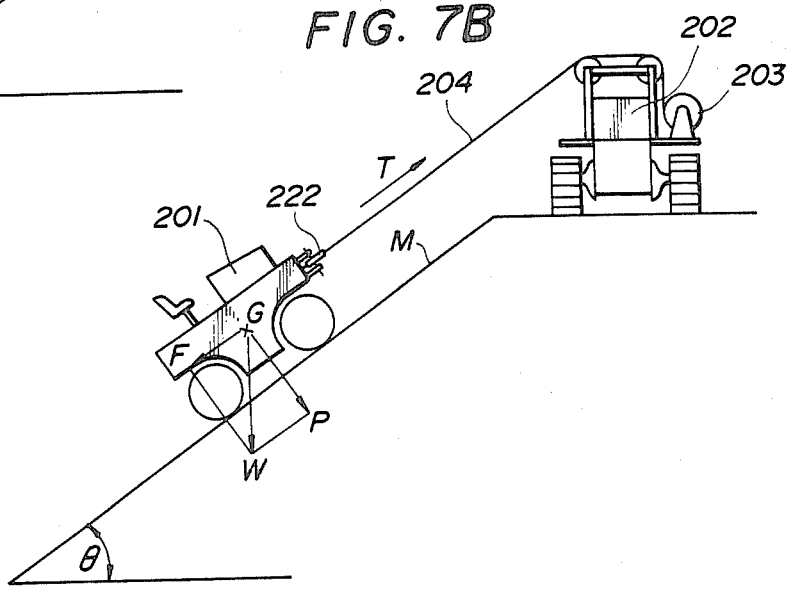

FIG. 7B illustrates another embodiment for using constant-tension winch according to the present invention, in which the roller 201 is moved along up and down direction on the slope to pave the surface.

In FIG. 7B, for such a compaction roller, the force component F acting on it can be computed where an angle $\theta$ of the slope is known, because this relationship holds: $F=W \sin\theta$, W being the weight of the roller and F being the force component which shows up as tensile force T of the rope from the winch drum 203. Under the indicated condition, the roller force perpendicular to the sloped surface is equal to force component P, so that in this condition the roller is no different from when it is working on a horizontal surface. This means that the roller may be arranged to roll forward or rearward by its own power as controlled from its gearshift lever. In FIG. 7, the rope block on the roller is indicated at 222.

Figure 9:
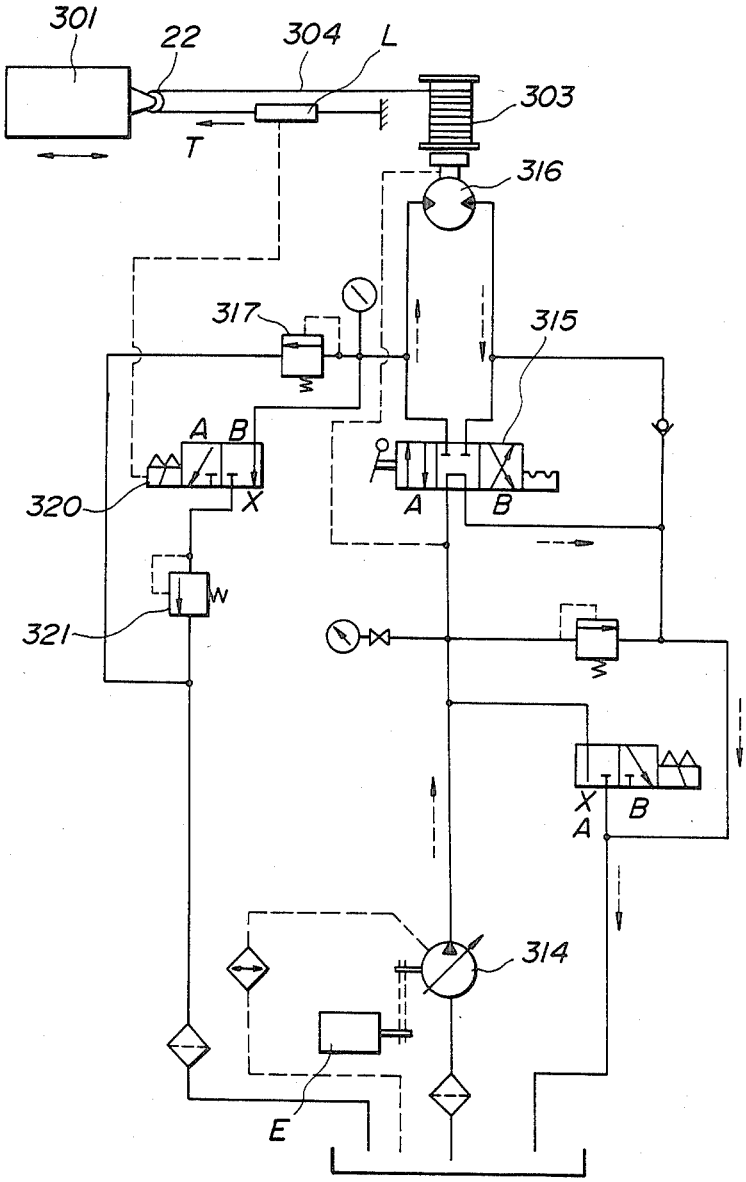
FIG. 9 is a circuit diagram of a hydraulic winch.

For the reason stated above, a hydraulic winch is to be used for the winch 203. The winch is so arranged as to maintain a constant tension in the rope 204 by detecting its tensile force. As shown in FIG. 9, engine E drives a hydraulic pump 314 to produce a high-pressure oil flow in the direction of a broken-line arrows, and a selector valve 315 is such that moving it into port A position sets a hydraulic motor 316 in operation to drive winch 303 in winding-up direction. Now, a relief valve 317 is to be set at such a pressure level as will give to the wire rope tensile force T necessary for exerting a stable pull to a roller 301 when a wire rope 304 is being so wound up and drawn in by a winch 303. Under this arrangement, the relief valve 317 operates to bleed high-pressure oil when the tension in wire rope becomes equal to T, thereby causing the winch to halt: at this point, the hydraulic pump 314 automatically reduces its discharge flow.

Stated differently, the winch 303 develops a constant winding-up force in order to maintain a constant tension in the wire rope 204. Suppose the roller 301 is attempting to move uphill along the line of slope by its own power, resulting in a decrease in the tension of the wire rope 204: this causes the pressure inside hudraulic motor to fall and, consequently, the winch 303 starts running in winding-up direction. If, conversely, the roller 301 starts moving downhill, the wire rope experiences a larger pull and its tension increases. This increase is detected by a load meter L, whose output signal initiates a shifting action on a selector valve 320 to move it into port A position, so that relief valve 313 bleeds high-pressure oil out. This causes a hydraulic motor 316 to run in reverse direction to pay put the wire rope 304. In FIG. 9, a numeral 321 shows a relief valve, and 322 is a pully.

It will be seen in the foregoing description that, with the roller towing device, the roller is enalbed to roll forward and rearward by its own power in the same way as when it is working on a level surface and to do away with the two-operator control that is required in the conventional machines. Thus, the hazard of mutual signaling involved in two operators working in a coordinated manner as well as the danger of misoperation is eliminated and, moreover, even in the event of wire rope failure the roller will not go into an extremely dangerous condition of wild coasting on the sloped surface.

Figure 8:
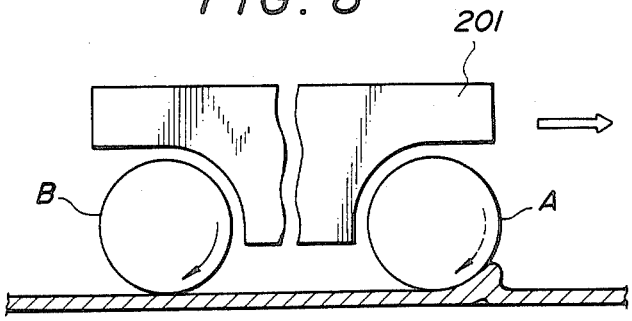
FIG. 8 illustrates, schematically, the manner of the spread asphalt mixture being pushed up by a towed rolling wheel and the manner of the same mixture being run over and compacted flat by a driven rolling wheel, for the purpose of comparing the two.

Since the rolling wheels of roller 201 are driven by the engine, each wheel rides over the spread mixture, as shown by wheel B, without pushing the spread mixture, as shown by wheel A in FIG. 8. In the embodiment of this invention, a higher degree of compacting performance can be realized by driving both front and rear compacting wheels from the engine. In the illustrated example, an electric motor may be usd in the place of the hydraulic motor for driving the winch.

We claim:

1. A slope paving apparatus for paving a sloped surface extending from a horizontal ground surface, said apparatus comprising:

a truck having a wheel positioned on a track extending on the horizontal ground surface;

a boom comprising a plurality of sections, the boom having means to permit the number of sections to be increased by adding sections or decreased by removing sections to vary the boom length as desired, the boom being mounted on and extending from the truck;

a winch means on said truck including a first wire for supporting the boom by said first wire for adjusting the angle of the boom with respect to the truck;

a longitudinally adjustable conveyor extending from the truck above and in alignment with the boom;

a pavement finisher suspended from the distal end of the boom, the pavement finisher receiving a paving mixture from the adjustable conveyor and spreading the mixture on the slope, wherein the pavement finisher moves across the slope with the movement of the truck; and a supporting means mounted on the top of the boom for supporting the pavement finisher, wherein the supporting means adjusts the position of the pavement finisher along the slope.

2. A slope paving machine according to claim 1 wherein the adjustable conveyor comprises at least a pair of sequential conveyors.

3. A slope paving machine according to claim 1 wherein the pavement finisher is further suspended by a second wire.

4. A slope paving machine according to claim 3 wherein said first and second wires are maintained with a constant tension.

* * * * *